US005735392A

United States Patent [19]

Shirasaka

[11] Patent Number: 5,735,392

[45] Date of Patent: Apr. 7, 1998

[54] SWITCHING DEVICE

[75] Inventor: Takeshi Shirasaka, Miyagi-ken, Japan

[73] Assignee: Alps Electric Co., Ltd., Tokyo, Japan

[21] Appl. No.: 829,770

[22] Filed: Mar. 31, 1997

[30] Foreign Application Priority Data

Apr. 4, 1996 [JP] Japan ..... 8-082739

[51] Int. Cl.[6] ..... H01H 21/00

[52] U.S. Cl. ..... 200/553; 200/556; 200/558; 200/559

[58] Field of Search ..... 200/553, 557, 200/558, 339, 559, 560, 561, 556

[56] References Cited

U.S. PATENT DOCUMENTS

| | | | |
|---|---|---|---|
| 5,446,253 | 8/1995 | Oshgan | 200/556 |
| 5,468,926 | 11/1995 | Sato | 200/558 |
| 5,647,479 | 7/1997 | Gernhardt et al. | 200/553 |
| 5,669,487 | 9/1997 | Sakata | 200/558 |

*Primary Examiner*—David J. Walczak
*Attorney, Agent, or Firm*—Guy W. Shoup

[57] ABSTRACT

A switching device which can be changed into a lock type switching device, or a non-lock type switching device with the least number of replacement components is disclosed. The switching device includes: first and second fixed contacts mounted in parallel on the bottom of a base; first and second contact pieces which are pivotally arranged on the first and second fixed contacts, and which can be in contact with the first and second fixed contacts, respectively; a lever pivotally supported by the base; two driving rods which are elastically held in the lever in a removable manner, and whose tips slide on the first and second movable contact pieces, respectively, while being in contact therewith; and a locking member which is replaceable with the first movable contact piece (or the second movable contact piece 21), and having a convex cam surface formed on the upper surface thereof with which one of the driving rods slidably comes into contact.

2 Claims, 10 Drawing Sheets

SWITCHING DEVICE

BACKGROUND OF THE INVENTION

1. Field of the Invention

The present invention relates to a switching device for use in an operation switch, etc. of an automobile power window in which a seesaw-type movable contact is used to perform switching.

2. Description of the Related Art

So-called seesaw-type switching devices in which movable contacts are pivoted about a fulcrum to perform contacting and/or separating operations between the movable contacts and fixed contacts can pass a large current. Therefore, seesaw-type switching devices have been widely used in power switches, etc. for turning on and off the power of a motor for an automobile power window.

A conventional switching device of this type will be described with reference to FIGS. 8 and 9.

As shown in FIG. 8, opposite outer surfaces of a box-like base 1 with a bottom are extended upward to form side plates 1*a*, 1*a*. A lever 2 is rotatably fitted to the side plates 1*a*, 1*a*. Support shafts 3 are substantially horizontally provided on the opposite side surfaces of the lever 2, and a knob 4 is provided on the upper surface of the lever 2. The lower part of the lever 2 is divided into two sections, and mounting holes 2*a*, 2*b* are formed in each of the lower surfaces of the divided sections. Driving rods 6, 6 are elastically held in the mounting holes 2*a*, 2*b*, respectively in a removable manner through coil springs 5, 5.

On the other hand, first fixed contacts 7*a*, 7*b* and second fixed contacts 8*a*, 8*b* are mounted in parallel on the bottom of the base 1. Support plates 9*a*, 9*b* are fixed on the substantial center of the inner bottom surface of the base 1 between the first fixed contacts 7*a*, 7*b*, and on the substantial center of the inner bottom surface of the base 1 between the second fixed contacts 8*a*, 8*b*, respectively. Substantial middle portions of first and second movable contact pieces 10*a*, 10*b*, which are formed by bending belt-shaped metal plates into substantial M-shapes, are arranged on the support plates 9*a*, 9*b*, respectively. In this way, two pairs of switch sections, i.e., the first fixed contacts 7*a*, 7*b* and the first movable contact piece 10*a*, and the second fixed contacts 8*a*, 8*b* and the second movable contact pieces 10*b*, are constructed.

According to the thus constructed conventional switching device, in a neutral position where the knob 4 is not operated, one end of the first movable contact piece 10*a* is in contact with one fixed contact 7*b* of the first fixed contacts 7*a*, 7*b*, as shown in FIG. 9A. In addition, in the neutral position, one end of the second movable contact piece 10*b* is in contact with one fixed contact 8*a* of the second fixed contacts 8*a*, 8*b*, and both switching sections are turned off.

When the knob 4 is operated to rotate the lever 5 counterclockwise, one driving rod 6 slides on the first movable contact piece 10*a* toward the first fixed contact 7*a* while pressing the first movable contact piece 10*a*. When the driving rod 6 crosses over the support plate 9*a*, the first movable contact piece 10*a* pivots about the support plate 9*a*, and the other end of the first movable contact piece 10*a* comes into contact with the first fixed contact 7*a*, but does not come into contact with the other fixed contact 7*b*, so that a switching operation of one switch section is performed, as shown in FIG. 9B. Incidentally, rotation of the lever 2 allows the other driving rod 6 to slide on the second movable contact piece 10*b* toward the second fixed contact 8*a*.

However, the second movable contact piece 10*b* is already in contact with the second fixed contact piece 8*a*, and does not pivot. Thus, a switching operation of the other switch section is not performed.

When the lever 2 is rotated counterclockwise from the condition shown in FIG. 9A, a switching operation is performed on the other switch section in contract with the above description, and a switching operation is not performed in one switch section.

FIG. 10 illustrates an example of the switching device used as a power switch for a motor M in which the switching device is turned off.

The above-described conventional switching device rotates the lever 2 by tilting the knob 4, pivots the first or the second movable contact piece 10*a* or 10*b* in accordance with the direction of rotation of the lever 2, and performs contacting and separating operation between the first or the second movable contact piece 10*a*, or 10*b* and the first or the second fixed contacts 7*a*, 7*b*, or 8*a*, 8*b*, thereby effecting a switching operation. When a tilting force to the knob 4 is released, the driving rods 6, 6, i.e., the knob 4, is returned to the neutral position by the first and the second movable contact pieces 10*a*, 10*b*.

The above-described switching device is a seesaw-type switching device which performs a non-lock type clicking operation. Such a switching device is used in many different fields, and general versatility and reduction in cost of the switching device are required. The general versatility of the switching device also requires commonality of components with a lock type switching device which performs a clicking operation and maintains a switched state after the switching operation, thereby reducing the cost of the switching device.

SUMMARY OF THE INVENTION

It is an object of the present invention to provide a switching device which permits components thereof to be used in common, and which can be changed to a lock type switching device, or a non-lock type switching device with the least number of replacement components.

It is another object of the present invention to provide a switching device which can provide a lock type switching device by only removing the first or the second movable contact piece from its storage section and attaching a locking member thereto.

According to an aspect of the present invention, there is provided a switching device, comprising: first and second fixed contacts mounted in parallel on the bottom of a base; a first movable contact piece and a second movable contact piece which are pivotally arranged on the first and the second fixed contacts, and which can be in contact with the first and the second fixed contacts, respectively; a pivot member pivotally supported by the base; driving rods which are elastically held in the pivot member in a removable manner, and whose tips slide on the first movable contact piece and the second movable contact piece, respectively, while being in contact therewith; and a locking member which is replaceable with either of the first movable contact piece and the second movable contact piece, and having a convex cam surface formed on the upper surface thereof with which one of the driving rods slidably comes into contact, wherein the first movable contact piece and the second movable contact piece are mounted on the base, the pivot member is located in a neutral position by the driving rods when pressing force is not applied on the pivot member, the first movable contact piece is brought into contact with one of the first fixed contacts and the second movable contact piece is brought into contact with one of the second fixed contacts, and, when the pivot member is pivoted by applying thereto the pressing force, the first movable contact piece is brought into contact with the other one of the first fixed contacts and the second movable contact piece is brought into contact with the other one of the second fixed contacts, and wherein, when said locking member is attached to the base in place of either of the first movable contact piece and the second movable contact piece, the pivot member is held at a tilted position by the driving rods elastically brought into contact with the locking member so as to bring the remaining second movable contact piece into contact with one of the second fixed contacts, or bring the remaining first movable contact piece into contact with one of the second fixed contacts.

DESCRIPTION OF THE PREFERRED EMBODIMENT

Figure 1:
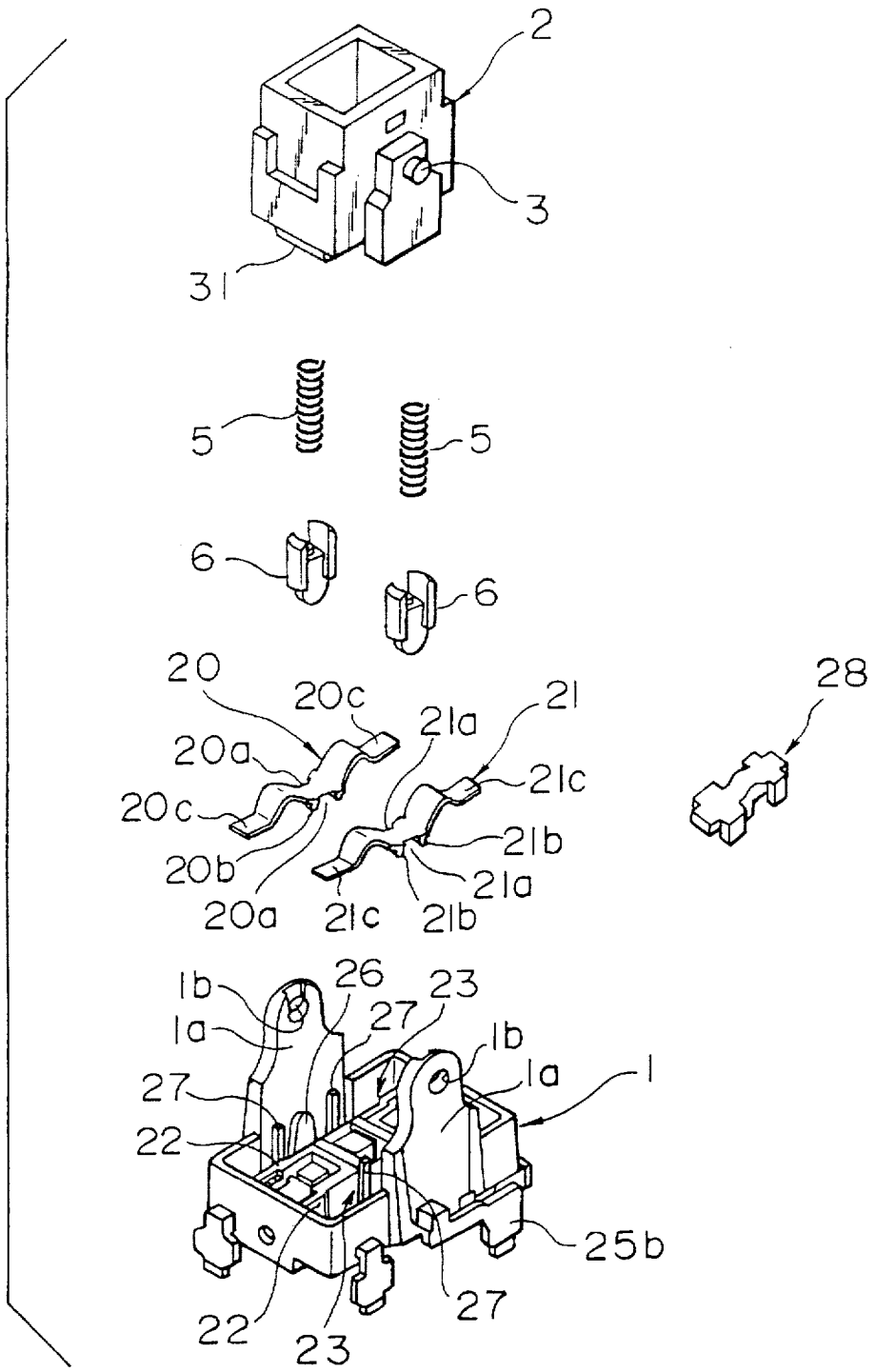
FIG. 1 is an exploded perspective view of a switching device according to an embodiment of the present invention.

An embodiment of the present invention will now be described with reference to FIGS. 1 to 7. In the drawings, the components which are substantially same as those of the above prior arts are indicated by the same reference numerals to omit overlapping description.

As shown in FIG. 1, in a base 1 of the switching device of this embodiment, walls 22, 22 for forming storage sections 23, 23 in which a first and a second movable contact pieces 20, 21 are separately stored are integrally formed between side plates 1*a*, 1*a*.

In one of the storage sections 23, 23, there are disposed a central support plate 25 for supporting a substantial middle portion of the first movable contact piece 20, a control projection 26 to which cutouts formed in both side edges at the center of the first movable contact piece 20 are fitted, projections 27, 27 projected to form recesses on both sides of the control projection 26, and first fixed contacts 7*a*, 7*b* which are brought into contact with both ends of the first movable contact piece 20 when it is pivoted.

Figure 2:
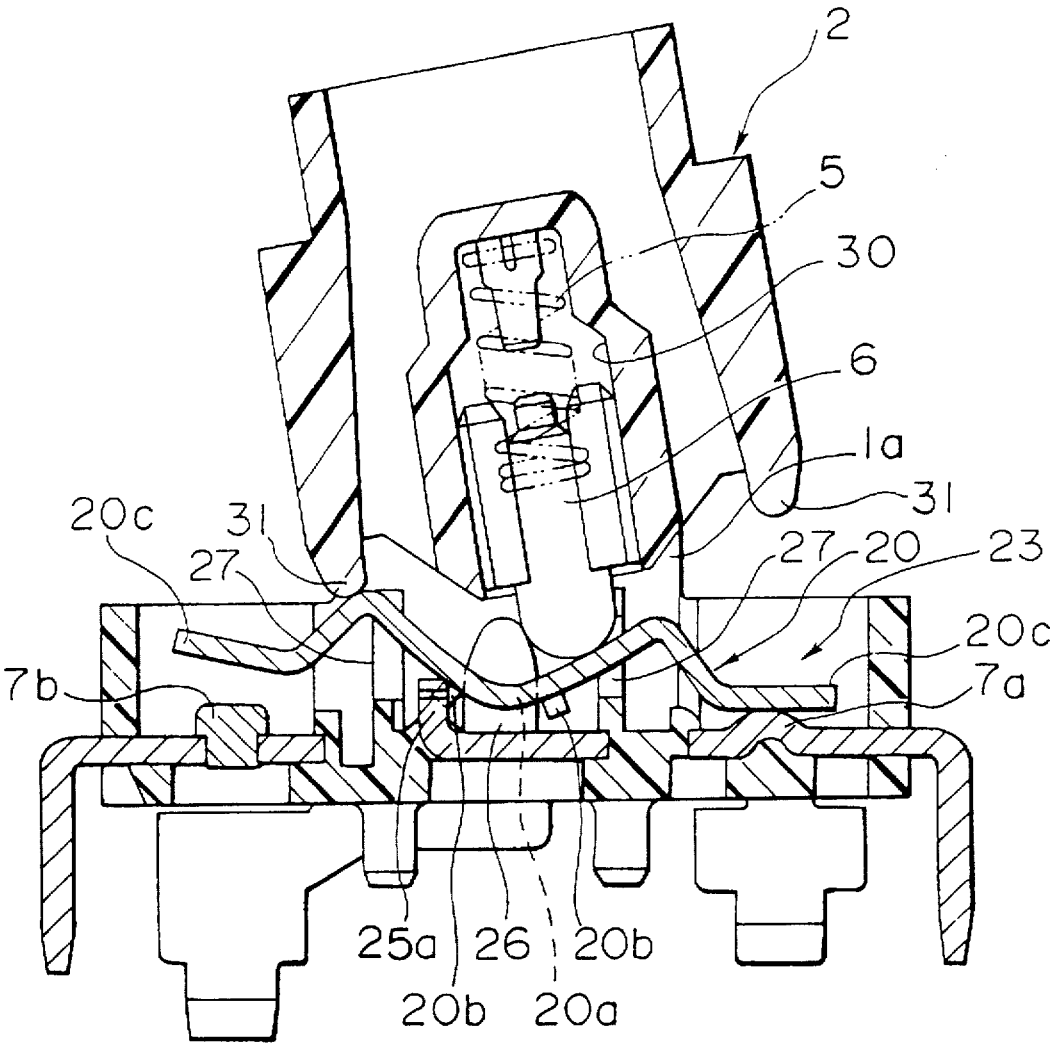
FIG. 2 is a vertical section showing the switching device of the present invention changed to a non-lock type switching device.

In addition, in the other storage section 23, similar to the above storage section 23, there are disposed a central support plate 25 for supporting a substantial middle portion of the second movable contact piece 21, a control projection 26 to which cutouts formed in both side edges at the center of the second movable contact piece 21 are fitted, projections 27, 27 projected to form recesses on both sides of the control projection 26, and second fixed contacts 8*a*, 8*b* which are brought into contact with both ends of the second movable contact piece 21 when it is pivoted. Both central support plates 25, 25 are arranged in the direction opposite to each other. Therefore, although a vertical cross section of the first movable contact piece 20 is shown in FIG. 2, the cross section of the second movable contact piece 21 is reversed from right to left of FIG. 2. In a condition of a lever 2 shown in FIG. 2, the second movable contact piece 21 is in contact with the second contact 8*b*, but is not in contact with the second fixed contact 8*a*.

The first and the second movable contact pieces 20, 21 are provided with cutouts 20*a*, 21*a* formed in both side edges at the center thereof, cut and raised pieces 20*b*, 21*b* for forming cutouts 20*a*, 21*a*, and contact portions 20*c*, 21*c* whose both ends are extended so as to be brought into contact with and separated from the first fixed contacts 7*a*, 7*b*, and the second fixed contacts 8*a*, 8*b*. The first and second movable contact pieces 20, 21 are pivotally supported by a rising portion 25*a* of the central support plate 25 near the center of the lower surfaces thereof, and driving rods 6, 6 slide on the upper surface of the first and the second movable contact pieces 20, 21 while being pressed into contact therewith.

Similar to the prior art, by storing the first and the second movable contact pieces 20, 21 in the storage sections 23, 23, the switching device can be changed to a non-lock type seesaw switching device.

On the other hand, the locking member 28 is attached and fixed to one of the storage sections 23, 23 in place of the first movable contact piece 20 or the second movable contact piece 21, whereby the switching device can be changed to a lock type seesaw switching device.

The locking member 28 for changing the non-lock type seesaw switch to the lock type seesaw switch includes a cam surface 28*a* angled with a substantial center of the upper surface raised, a recess 28*b* formed in one end of the lower surface thereof in which the rising portion 25*a* of the central support plate 25 is placed, and two ribs 28*c* formed on both side surfaces thereof, as shown in FIGS. 7A to 7F.

On the upper portion of the opposite side surfaces of the lever 2, support shafts 3, 3 are substantially horizontally projected, and the support shafts 3, 3 are rotatably inserted into shaft holes 1*b*, 1*b* formed in the side plates 1*a*, 1*a* of the base 1. In addition, similar to the above-described prior art, storage holes 30, 30 are formed in the lever 2. Further, at the lower edge of the lever 2 in the direction of rotation, projections 31, 31 are formed. The projections 31, 31 abut against the upper edge of the wall 22 after the lever 2 has rotated to some extent so as to control excessive rotation of the lever 2.

Terminals 32*a*, 32*b*, 33*a*, 33*b* of the first and the second fixed contacts 7*a*, 7*b*, 8*a*, 8*b* and terminals 25*b*, 25*b* of the central support plates 25, 25 are drawn out at the side surfaces of the base 1.

Figure 3:
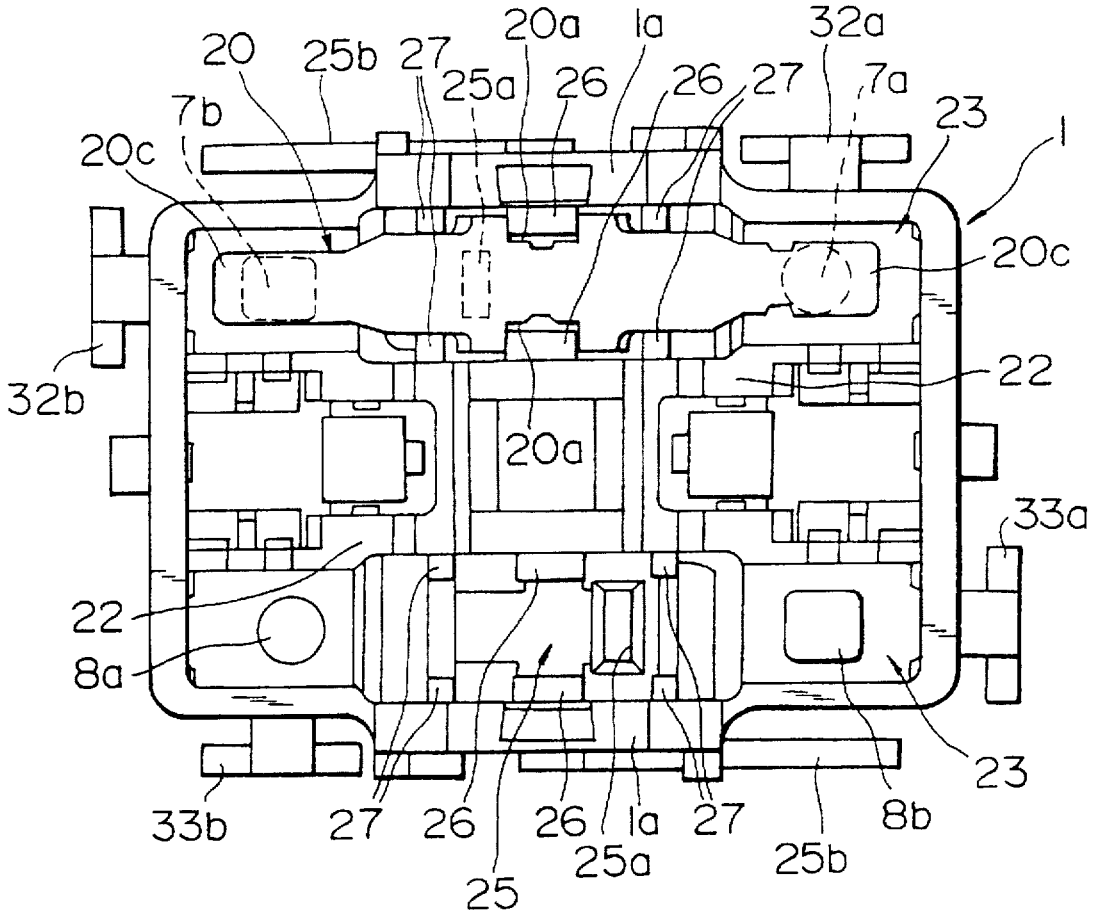
FIG. 3 is a plan view in which a lever and one of movable contact pieces are removed.
Figure 4:
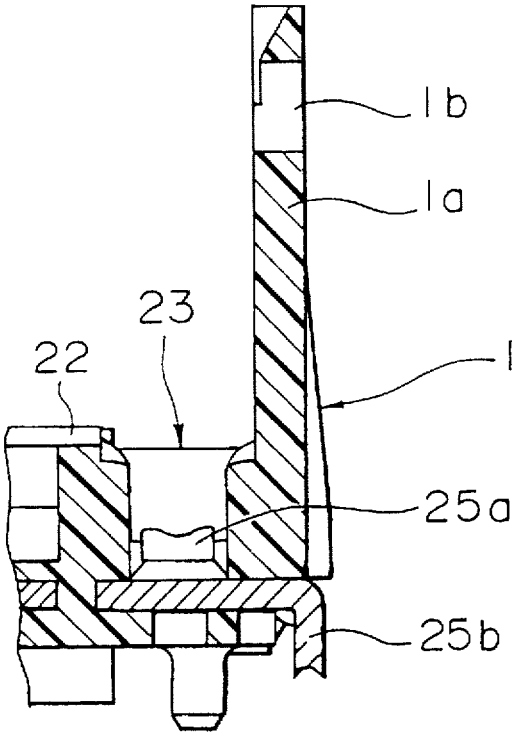
FIG. 4 is a vertical section showing only half of a base.

As described above, when the first and the second movable contact pieces 20, 21 are attached to the storage sections 23, 23, the switching device is changed to a non-lock type seesaw switching device, as shown in FIGS. 2 and 3, and the switching device provides the same operation as the prior art. Thus, description of the operation is omitted.

Figure 5:
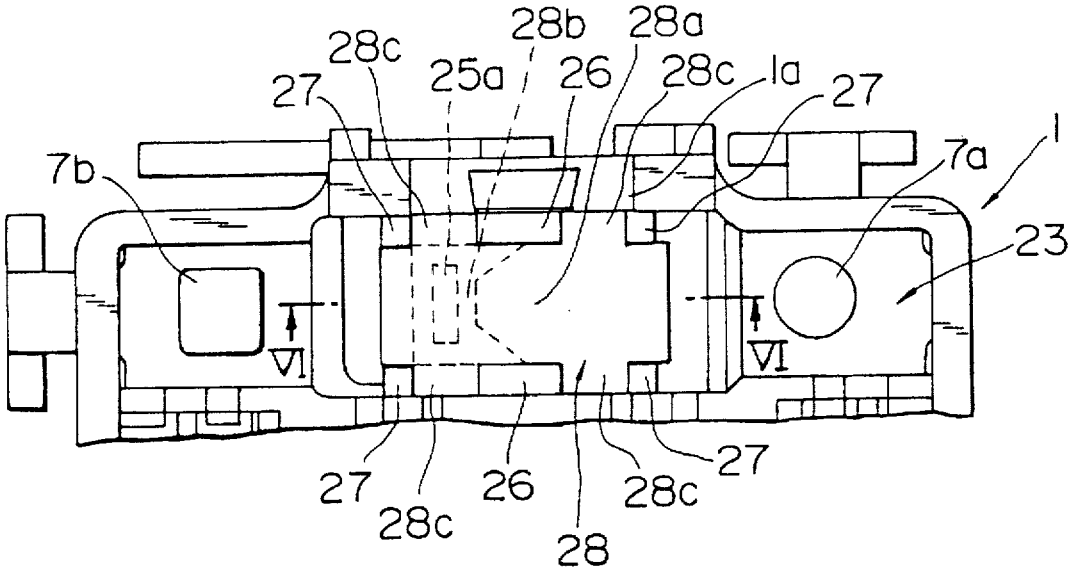
FIG. 5 is a main part plan view showing the switching device of the present invention changed to a lock type switching device.
Figure 6:
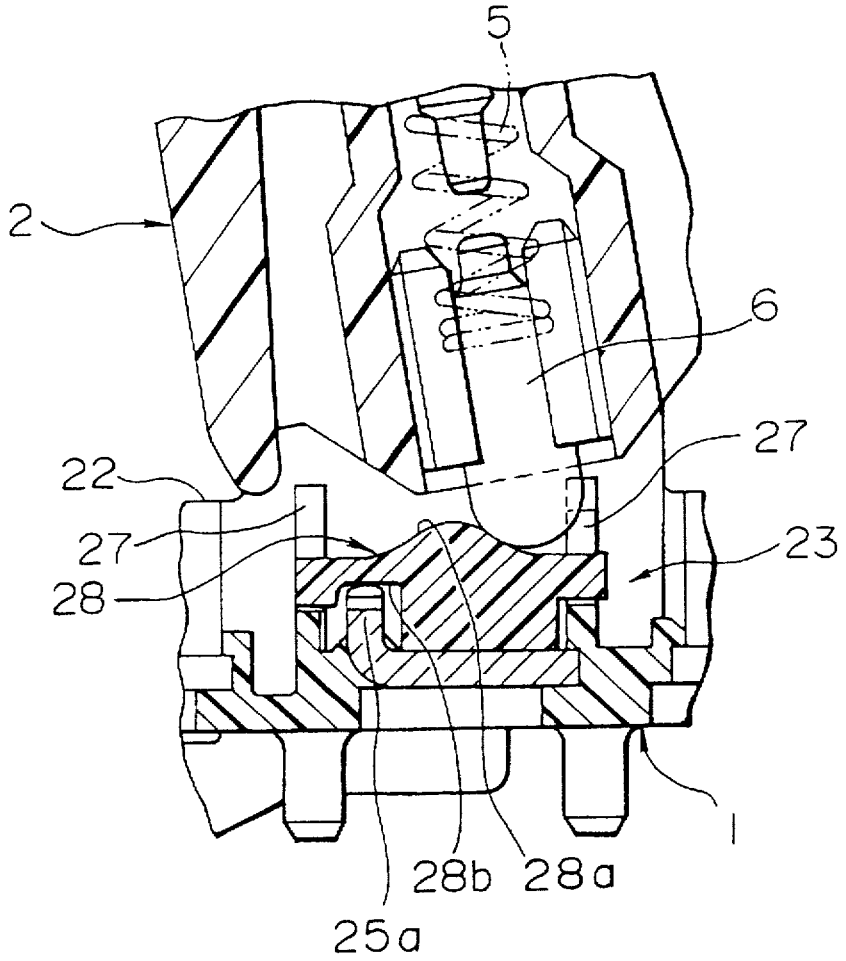
FIG. 6 is a main part vertical section taken along the line VI—VI in FIG. 5.
Figure 7A:
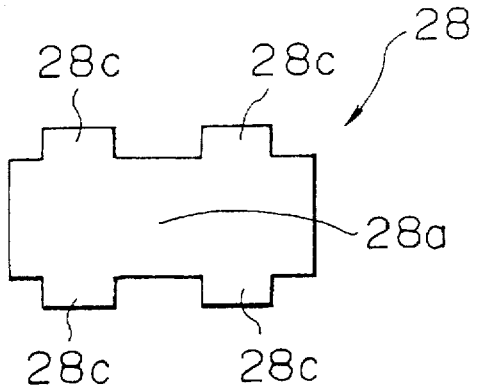
FIGS. 7A to 7F are a plan view, a left side view, a front view, a right-side view, a bottom view, and a vertical section of a locking member, respectively.
Figure 7B:
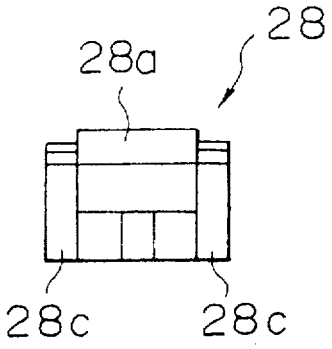
Figure 7C:
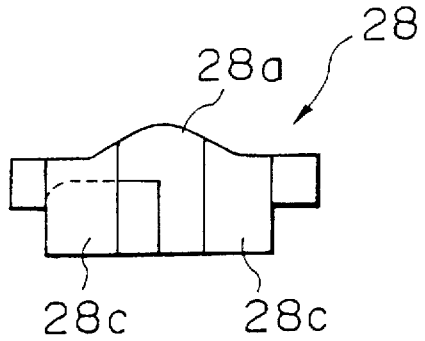
Figure 7D:
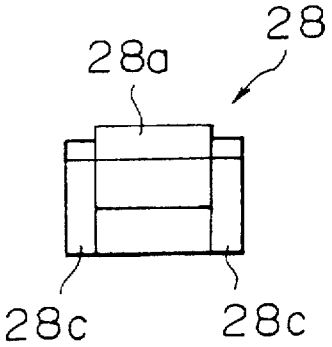
Figure 7E:
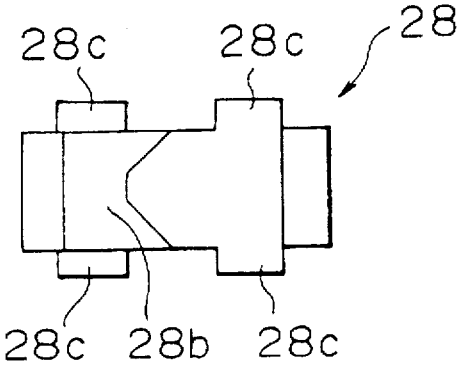
Figure 7F:
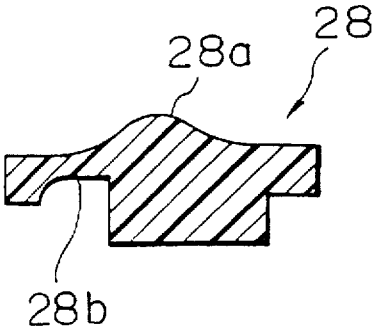
Figure 8:
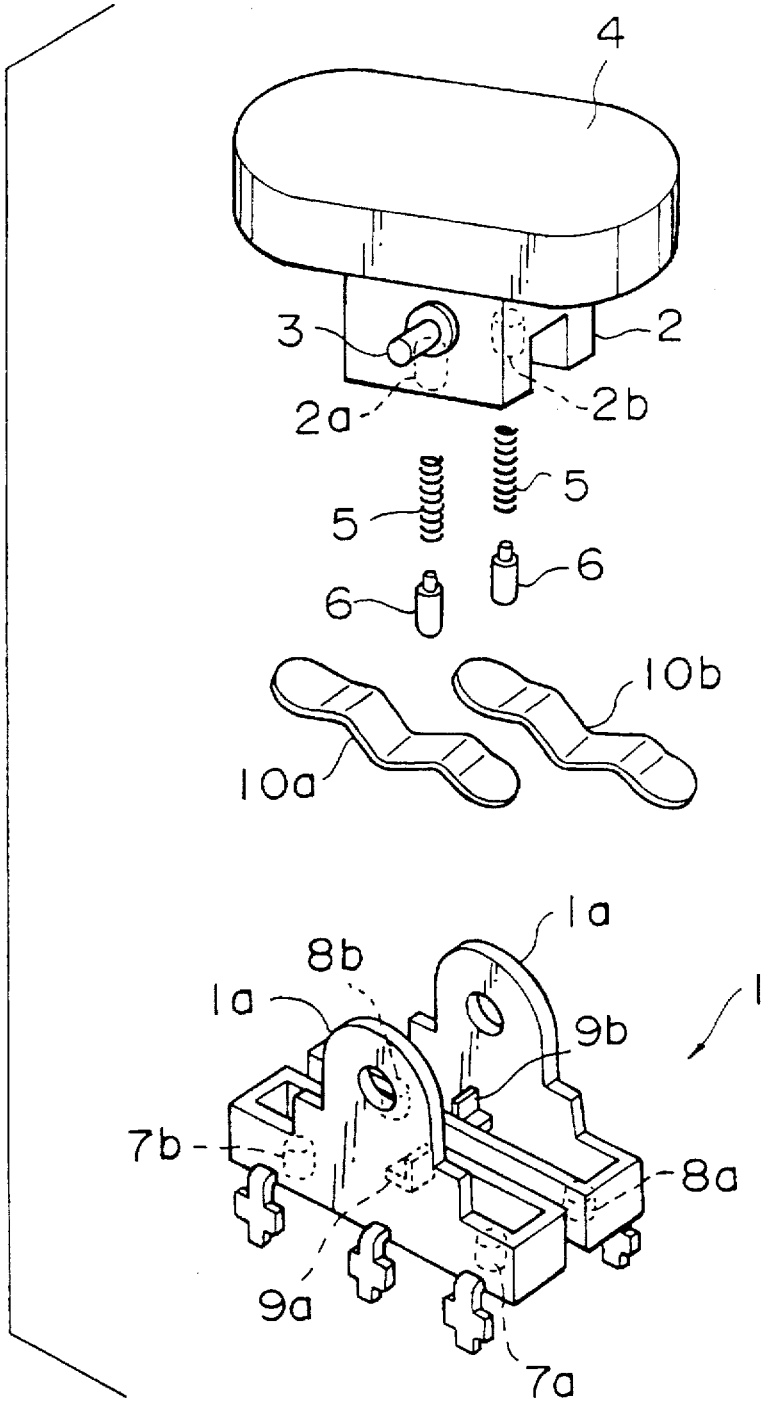
FIG. 8 PRIOR ART
FIG. 8 is an exploded perspective view showing a conventional switching device.
Figure 9A:
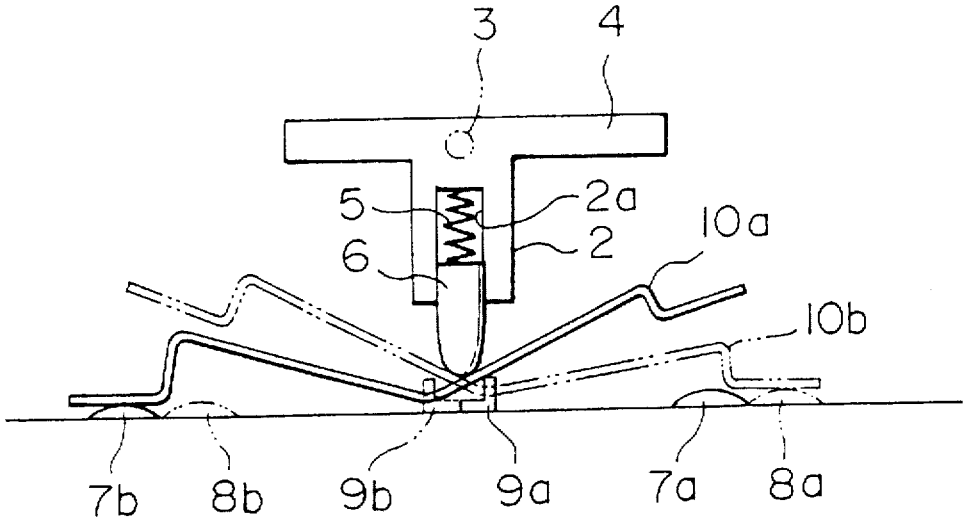
FIG. 9A PRIOR ART
FIGS. 9A and 9B illustrate operations of a conventional switching device.
Figure 9B:
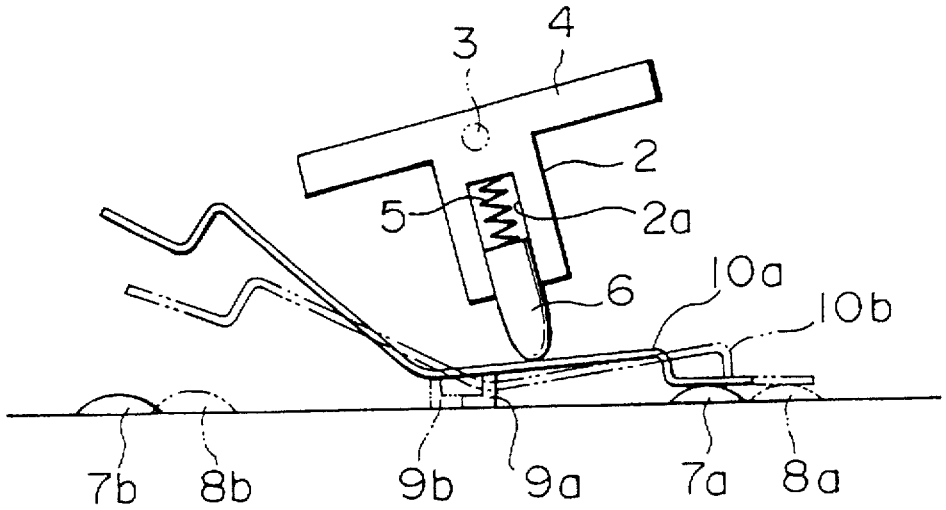
FIG. 9B PRIOR ART
Figure 10:
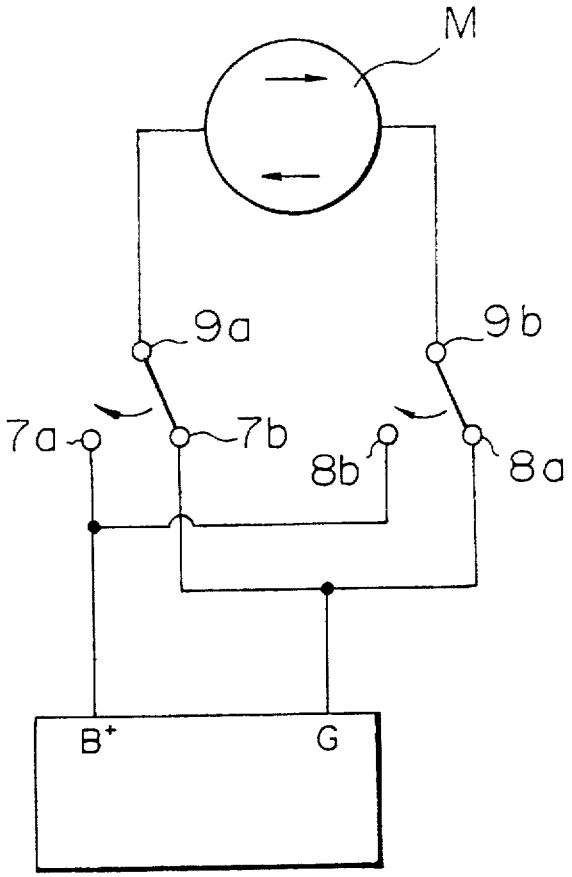
FIG. 10 PRIOR ART
FIG. 10 is a circuit diagram schematically showing usage of the conventional switching device.

A case will be described where the first movable contact piece 20 (or the second movable contact piece 21) is removed, and the locking member 28 is attached in such a manner that the recess 28*b* of the locking member 28 is put on the rising portion 25*a* of the central support plate 25 so as to change the switching device to a lock type seesaw switching device as shown in FIGS. 5 and 6.

That is, the first movable contact piece 20 is removed from the storage section 23 of the base 1, and ribs 28*c*, 28*c* . . . are respectively fitted and fixed into recesses formed between the control projection 26 and projections 27, 27 of the storage section 23. This fixation allows the rising portion 25*a* of the central support plate 25 to be placed in the recess 28*b* of the locking member 28. And then, the switching device may be assembled in the same manner as the non-lock type switching device.

The operation of the switching device thus changed to the lock type seesaw switching device will now be described.

When the lever 2 is tilted in a condition of FIG. 6, the lever 2 is tilted in the same direction as that of FIG. 2, and the second movable contact piece 21 is in contact with the fixed contact 8*b*. When the lever 2 is rotated clockwise from the condition of FIG. 6, the driving rod 6, which has been in contact with the right inclined surface of the angled cam surface 28*a* of the locking member 28, slides to the left on the cam surface 28*a* of the locking member 28, crosses over the peak of the cam surface 28*a*, and comes into contact with the left inclined surface. Even if the rotation force applied to the lever 2 is released, the driving rod 6 cannot cross over the peak of the cam surface 28*a* with returning force of the lever 2. Therefore, the lever 2 does not return to a neutral position where the lever 2 stands upright with respect to the base 1, and remains locked in a tilted condition.

In addition, by the clockwise rotation of the lever 2, the driving rod 6 slides on the second movable contact piece 21 toward the second fixed contact 8*a* while pressing the second contact piece 21. When the driving rod 6 crosses over the central support plate 25, the second movable contact piece 21 pivots counterclockwise about the central support plate 25, so that one end of the second movable contact piece 21 comes into contact with the second fixed contact 8*a* and does not come into contact with the other fixed contact 8*b*. Since the lever 2 is locked in the tilted condition opposite to that of FIG. 6 as described above, the contact of the second movable contact piece 21 and the second fixed contact 8*b* is maintained.

Further, when the lever 2 is rotated counterclockwise from the above-described contacting condition, the driving rod 6 slides on the second movable contact piece 21 toward the second fixed contact 8*b* while pressing the second contact piece 21. When the driving rod 6 crosses over the central support plate 25, the second movable contact piece 21 pivots clockwise about the central support plate 25, so that the other end of the second movable contact piece 21 comes into contact with the second fixed contact 8*b* and does not come into contact with the other second fixed contact 8*a*. At the same time, the driving rod 6, which has been in contact with the left inclined surface of the angled cam surface 28*a* of the locking member 28 by the counterclockwise rotation of the lever 2, crosses over the peak of the angled cam surface 28*a*, and comes into contact with the right inclined surface. The lever 2 remains locked in the tilted condition, so that the contact of the second movable contact piece 21 and the second fixed contact 8*b* is maintained.

Incidentally, when the switching device is used as a lock type seesaw switching device, terminals 33*a*, 33*b*, and 25*b* of the storage section 23 on which the locking member 28 is fixed are not employed.

As described above, according to the present invention, there is provided a switching device, comprising: first and second fixed contacts 7*a*, 7*b*, and 8*a*, 8*b* mounted in parallel on the bottom of the base 1; first and second movable contact pieces 20, 21 which are pivotally arranged on these first and second fixed contacts 7*a*, 7*b*, and 8*a*, 8*b*, and can be in contact with these first and the second fixed contacts 7*a*, 7*b*, 8*a*, 8*b*, respectively; a lever 2 pivotally supported by the base 1; two driving rods 6, 6 which are elastically held in the lever 2 in a removable manner, and whose tips slide on the first and the second movable contact pieces 20, 21, respectively, while being in contact therewith; and a locking member 28 which is replaceable with the first movable contact piece 20 (or the second movable contact piece 21) of the base 1, and having a cam surface 28*a* formed on the upper surface thereof with which one of the driving rods 6, 6 slidably comes into contact, wherein the lever 2 is located on the neutral position by the driving rods 6, 6 when a pressing force is not applied to the lever 2, and, when the lever 2 is pivoted by applying thereto the pressing force, the first movable contact piece 20 is brought into contact with the first fixed contacts 7*a*, 7*b*, or the second fixed contacts 8*a*, 8*b*, and wherein the locking member 28 is attached to the base in place of the first movable contact piece 20 (or the second movable contact piece 21), and the lever 2 is held at a tilted position by the driving rods 6, 6 which are elastically brought into contact with the locking member 28 so as to bring the second movable contact piece 21 into contact with the first fixed contacts 7*a*, 7*b*, or with the second fixed contacts 8*a*, 8*b*.

Therefore, by only replacing the movable contact piece 20 or 21 in one of the switch sections constituted by the fixed contacts 7*a*, 7*b*, 8*a*, 8*b* and the movable contact pieces 20, 21 with the locking member 28, the switching device can be changed to a non-lock type switching device or a lock type switching device, so that the switching device usable in many different fields can be provided, and reduction of cost can be achieved because components can be used in common.

What is claimed is:

1. A switching device, comprising:

first and second fixed contacts mounted in parallel on the bottom of a base;

a first movable contact piece and a second movable contact piece which are pivotally arranged on said first and said second fixed contacts, and which can be in contact with said first and said second fixed contacts, respectively;

a pivot member pivotally supported by said base;

driving rods which are elastically held in said pivot member in a removable manner, and whose tips slide on said first movable contact piece and said second movable contact piece, respectively, while being in contact therewith; and a locking member which is replaceable with either of said first movable contact piece and said second movable contact piece, and having a convex cam surface formed on the upper surface thereof with which one of said driving rods slidably comes into contact, wherein said first movable contact piece and said second movable contact piece are mounted on the base, said pivot member is located in a neutral position by said driving rods when pressing force is not applied on said pivot member, said first movable contact piece is brought into contact with one of said first fixed contacts and said second movable contact piece is brought into contact with one of said second fixed contacts, and, when said pivot member is pivoted by applying thereto the pressing force, said first movable contact piece is brought into contact with the other one of said first fixed contacts and said second movable contact piece is brought into contact with the other one of said second fixed contacts, and wherein, when said locking member is attached to said base in place of either of said first movable contact piece and said second movable contact piece, said pivot member is held at a tilted position by said driving rods elastically brought into contact with said locking member so as to bring said remaining second movable contact piece into contact with one of said second fixed contacts, or bring said remaining first movable contact piece into contact with one of said first fixed contacts.

2. A switching device according to claim 1, wherein said base includes both a storage section for storing said first movable contact piece or said second movable contact piece, and a storage section to which said locking member is attached and fixed in place of said first movable contact piece or said second movable contact piece.

* * * * *